US007806524B2

(12) United States Patent
Watanabe et al.

(10) Patent No.: US 7,806,524 B2
(45) Date of Patent: Oct. 5, 2010

(54) PLATEN FOR MARGINLESS IMAGE RECORDING AND IMAGE RECORDING APPARATUS WITH SUCH A PLATEN MOUNTED THEREIN

(75) Inventors: Yusaku Watanabe, Nagoya (JP); Yuji Koga, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 554 days.

(21) Appl. No.: 11/191,054

(22) Filed: Jul. 28, 2005

(65) Prior Publication Data

US 2006/0023052 A1 Feb. 2, 2006

(30) Foreign Application Priority Data

Jul. 28, 2004 (JP) ..... 2004-220070

(51) Int. Cl.
*B41J 2/01* (2006.01)

(52) U.S. Cl. ..... 347/104

(58) Field of Classification Search ..... 347/101, 347/104, 16, 36, 12, 41, 37
See application file for complete search history.

(56) References Cited

U.S. PATENT DOCUMENTS 5,148,187 A * 9/1992 Ono et al. ..... 347/218
5,291,227 A 3/1994 Suzuki
5,920,405 A * 7/1999 McIntyre et al. ..... 358/442
6,239,817 B1 * 5/2001 Meyer ..... 347/36
6,270,215 B1 8/2001 Miyasaka et al.
6,471,202 B1 * 10/2002 Sugimura ..... 271/10.11
6,616,361 B2 * 9/2003 Sugiyama ..... 400/642
6,840,617 B2 * 1/2005 Crosby et al. ..... 347/104
6,886,909 B2 * 5/2005 Ogasawara ..... 347/35
2002/0041303 A1 4/2002 Yoshinaga
2002/0089564 A1 * 7/2002 Ohashi ..... 347/41

(Continued)

FOREIGN PATENT DOCUMENTS

JP 4-341848 11/1992

(Continued)

OTHER PUBLICATIONS

EPO Search Report for EP 05254726.2-2304.

(Continued)

*Primary Examiner*—Stephen D Meier
*Assistant Examiner*—Alexander C Witkowski
(74) *Attorney, Agent, or Firm*—Banner & Witcoff, Ltd

(57) ABSTRACT

An image recording apparatus has a platen supporting the under side of a sheet conveyed in a conveying direction. The platen has upstream ribs and a downstream rib, between which a marginless recording region lies. The platen also has first ribs, second ribs and third ribs, respectively supportable of front and rear end portions of the sheet, formed in the marginless recording region, and spaced at suitable intervals perpendicular to the conveying direction. Grooves are formed between the first to third ribs and extend in the conveying direction. An ink absorber is further provided on a bottom plate of the platen positioned under the downstream rib and communicates with groove absorbing a surplus portion of the discharged ink. The platen is simple in structure and performs marginless image recording without staining either side of the sheet with easy size control of the ink absorber.

19 Claims, 13 Drawing Sheets

U.S. PATENT DOCUMENTS

| | | | | |
|---|---|---|---|---|
| 2003/0081057 | A1 * | 5/2003 | Isono et al. | 347/37 |
| 2004/0189767 | A1 | 9/2004 | Kodama et al. | |
| 2005/0078147 | A1 | 4/2005 | Kodama et al. | |

FOREIGN PATENT DOCUMENTS

| | | | |
|---|---|---|---|
| JP | 10-337886 | A | 12/1998 |
| JP | 2000-118058 | | 4/2000 |
| JP | 2000-351205 | | 12/2000 |
| JP | 2002-103706 | | 4/2002 |
| JP | 2003103850 | A | 4/2003 |
| JP | 2003191499 | A | 7/2003 |
| JP | 2003-285479 | A | 10/2003 |
| JP | 2004-009407 | | 1/2004 |
| JP | 2004090463 | A | 3/2004 |

OTHER PUBLICATIONS

Notice for Reasons for Rejection dated Mar. 23, 2007 in Chinese Application No. 2005-100876365.

Partial English translation of Japanese Patent Application Laid-open No. 2002-103706 originally submitted on Jan. 5, 2006.

Office Action in corresponding Japanese Patent Application No. 2004-220070, mailed May 27, 2009, and English translation thereof.

* cited by examiner

PLATEN FOR MARGINLESS IMAGE RECORDING AND IMAGE RECORDING APPARATUS WITH SUCH A PLATEN MOUNTED THEREIN

FIELD OF THE INVENTION

The present invention relates to a platen for marginless image recording and an image recording apparatus in which such a platen is mounted. More specifically, the invention relates to a structure for recording an image from one end of a recording medium (sheet) to the other end (marginless image recording).

BACKGROUND OF THE INVENTION

A conventional ink jet printer has a carriage which can reciprocate in a predetermined direction (primary scanning direction). A recording head is mounted in or on the carriage and has an ink discharge surface facing downward. A recording sheet can be conveyed intermittently at regular intervals in a direction perpendicular to the primary scanning direction. A platen lies below the discharge surface of the recording head and faces the recording head. Ink droplets are discharged from the nozzles of the recording head onto the surface (upper surface) of the recording medium supported on the platen to form an image on the medium.

The recording head can discharge ink droplets in a zone including an image recording region. The printer may perform marginless image recording on a recording medium by starting the discharge of ink droplets before the leading end of the medium reaches the edge of the recording region disposed in downstream in the conveying direction, and by performing ink discharge until the trailing end of the medium leaves or passes through the edge of the recording region disposed in upstream in the conveying direction. In this case, there is a problem that the discharged droplets dropping outside both ends of the recording medium adhere to the top surface of the platen which lies below. As a result, these ink droplets stain the under side of the succeeding recording medium supported and sliding on the platen.

In order to solve this problem, the printer has been devised as disclosed in U.S. Pat. No. 6,239,817 corresponding to Japanese Patent Application Laid-open No. 2000-118058 (FIGS. 3 and 4A-4C). The recording head of this printer can record an image in an image recording region. The platen of the printer has an upstream wall and a downstream wall, which extend in a primary scanning direction. The upstream and downstream walls stand upright at the edges of the recording region that are upstream and downstream, respectively, in the primary scanning direction. The space between the walls is open upwardly, and an ink absorber is placed in the opened space. The upstream and downstream walls have wavy ribs formed on the top ends thereof, and protrude from the top ends, respectively.

According to the structure of the platen disclosed in U.S. Pat. No. 6,239,817 corresponding to Japanese Patent Application Laid-open No. 2000-118058, however, while a recording medium is passing over the platen, the medium needs to be out of contact with the top side of the ink absorber which is placed in the platen. Therefore, it is necessary to place the ink absorber so that its top side does not protrude over the top ends of the wavy ribs. This makes it necessary to insert, to the platen, an ink absorber which size and shape are strictly controlled. As a result, the incorporation of the ink absorber and other work take time.

If the opening space in the platen is large in area, the capacity of ink absorber can be enhanced. Conceivably, it is possible to make this opening space large in area only by increasing the distance between the upstream and downstream walls of the platen in the conveying direction. If the distance between the walls is long, a front end portion of a soft recording medium is likely to hang down when the leading end of the medium has passed over the wavy ribs of the upstream wall and is positioned in the opening space, namely, when the leading end portion is supported in the form of a cantilever by these ribs. Likewise, if this distance is long, a rear end portion of a soft recording medium is likely to hang down when the trailing end of the medium has passed over the wavy ribs of the upstream wall and is positioned in the space, namely, when the rear end portion is supported in the form of a cantilever by the wavy ribs of the downstream wall. In this case, the end portions of the recording medium are likely to come into contact with the top side of the ink absorber in the opening space, so that the under side of the medium is likely to be stained with ink.

In order to keep a recording medium out of contact with the ink absorber in the platen space, the vertical distance from the top side of the absorber to the top ends of the wavy ribs may be long. In this case, when the recording head discharges ink droplets erroneously without a recording medium lying on the platen during image recording, the droplets float in the form of ink mist over the absorber. When a recording medium enters the recording region, one or both sides of the medium may be stained by the ink mist.

SUMMARY OF THE INVENTION

In view of the foregoing problems, an object of the present invention is to provide a platen capable of marginless image recording without staining either side of a recording medium, and also capable of realizing an easy size control of an ink absorber. Another object of the present invention is to provide an image recording apparatus having such a platen.

According to a first aspect of the present invention, there is provided a platen which supports an under side of a recording medium being conveyed in a conveying direction in an image recording apparatus, and which is disposed below a recording head capable of marginless image recording on the recording medium. The platen comprises a plurality of upstream ribs which support the recording medium and which are disposed upstream in the conveying direction; a downstream rib which supports the recording medium and which is disposed downstream in the conveying direction outside an image recording region where the recording head records an image on the recording medium; a regional rib which supports a front end portion and a rear end portion of the recording medium, the regional rib extending in the conveying direction in a marginless recording region which extends from the upstream ribs to the downstream rib; and an ink absorber which absorbs surplus ink having dropped onto the regional rib, the ink absorber being positioned under the downstream rib.

During marginless image recording, the regional rib can support a front end portion (the leading end) and a rear end portion (the trailing end) of the recording medium. The regional rib is positioned in the marginless recording region. As a result, even when a front end portion (the leading end) and a rear end portion (the trailing end) of the recording medium are supported in the form of cantilevers and hang down, the under side of the recording medium is prevented from being stained with surplus ink. The surplus ink having dropped on the regional rib is guided to the ink absorber, which is positioned under the downstream rib outside the marginless recording region. Consequently, in comparison with a case where an ink absorber is positioned in the marginless recording region, there is no need for the manufacturing accuracy in the size, the shape, etc. of the ink absorber of this platen to be high so that the recording medium can be kept out of contact with the absorber. Because there is no limitation on the area in which the ink absorber is placed, the absorber can be large in size.

The platen may be used in an image recording apparatus which has a carriage reciprocatable in a predetermined direction and in which the recording medium is conveyed in a direction perpendicular to the reciprocating direction of the carriage. By combining the carriage movement and the medium conveyance, it is possible to record an image in an arbitrary position on the recording medium.

According to a second aspect of the present invention, there is provided an image recording apparatus which records an image on a recording medium being conveyed in a conveying direction. The image recording apparatus comprises a carriage which is reciprocatable in a direction perpendicular to the conveying direction; a recording head which performs marginless image recording on the recording medium by discharging ink droplets, the recording head being mounted on the carriage; and a platen which supports an under side of the recording medium, the platen being disposed below the recording head. The platen comprises a plurality of upstream ribs which support the recording medium, the upstream ribs being disposed upstream in the conveying direction; a downstream rib which supports the recording medium, the downstream rib being disposed downstream in the conveying direction outside an image recording region where the recording head records an image on the recording medium; and a regional rib which supports a front end portion and a rear end portion of the recording medium, the regional rib extending in the conveying direction in a marginless recording region which extends from the upstream ribs to the downstream rib.

During marginless image recording, the regional rib of the image recording apparatus according to the present invention can support a front end portion (the leading end) and a rear end portion (the trailing end) of the recording medium. The regional rib is positioned in the marginless recording region. As a result, even when the front end portion (the leading end) and the rear end portion (the trailing end) of the recording medium are supported in the form of cantilevers and hang down, its under side is prevented from being stained with surplus ink.

The image recording apparatus according to the present invention may further have a conveying unit which conveys the recording medium in the conveying direction. The conveying unit can convey a large number of recording media successively one after another to the image recording region.

The downstream rib of the platen mounted on the image recording apparatus according to the present invention may be formed continuously in a direction perpendicular to the conveying direction of the recording medium. This makes it easy for the downstream rib to take the form of a flat plate so that this rib is out of contact with the ink absorber, which is positioned under the rib. This also makes it possible to prevent the downstream rib and the ink absorber from abutting against or coming into contact with each other even when the absorber is thick.

A top end of the regional rib of the image recording apparatus according to the present invention may be lower than a surface on which the recording medium passes over the upstream ribs and the downstream rib at the same time. This prevents the under side of the recording medium from being stained, as long as the medium is kept to be flat, even when ink adheres to the top end of the regional rib.

The regional rib of the image recording apparatus according to the present invention may have first ribs formed to incline upwardly toward downstream in the conveying direction; second ribs which are horizontal; and third ribs formed to incline downwardly toward downstream in the conveying direction. In this case, the recording medium can possibly come into contact with only the upwardly inclined top ends of the first ribs of the regional ribs. This prevents more effectively the under side of the medium from being stained with surplus ink.

The regional rib of the image recording apparatus according to the present invention may have a plurality of ribs; and grooves may be formed between adjoining ribs of the ribs and extend in the conveying direction. The image recording apparatus may further comprise an ink absorber which absorbs surplus ink, and the ink absorber may be disposed in a position communicating with the grooves. In this case, the surplus ink having gathered on the regional ribs is guided through the grooves to the ink absorber. This prevents more effectively the under side of the recording medium from being stained with surplus ink.

In the image recording apparatus according to the present invention, the upstream ribs may extend in the conveying direction, and each of the first ribs may be aligned with an axial direction in which one of the upstream ribs extends in the conveying direction. Each of the second ribs may be interposed midway between adjoining first ribs of the first ribs so that the second ribs prevent the recording medium from hanging down between the first ribs. The third ribs may be interposed between the first and second ribs in the direction perpendicular to the conveying direction. In this case, the first, second and third ribs can be arranged at suitable intervals in the direction perpendicular to the conveying direction, and the grooves between these ribs can be large in number. This enables surplus ink to be guided quickly to the ink absorber through the grooves.

In the image recording apparatus according to the present invention, top ends of the first ribs may be lower than top ends of the upstream ribs; top ends of the second ribs may be lower than the top ends of the first ribs; and top ends of the third ribs may be lower than the top ends of the second ribs. In this case, even when the recording medium hangs down, the recording medium comes into contact only with portions of the first, second and third ribs. This prevents the under side of the recording medium from being stained with surplus ink.

In the image recording apparatus according to the present invention, the downstream rib may be detachable from the platen; the platen may further comprise a bottom plate positioned under the downstream rib; and the ink absorber may be mounted on the bottom plate. In this case, the ink absorber can be positioned under the downstream rib positioned outside the image recording region. This enables the downstream rib to support a recording medium on which an image has been recorded. As a result, it is easy to keep the recording medium out of contact with the ink absorber.

In the image recording apparatus according to the present invention, the platen may have a base plate on which the ink absorber is disposed and have ink channels extending from the regional ribs to the base plate. In this case, a space for housing the ink absorber is provided over the base plate at a low position in the platen, enabling the ink absorber to absorb surplus ink through the ink channels which extend from the platen to the absorber.

In the image recording apparatus according to the present invention, the platen may further include a flat plate on which the upstream ribs are integrally formed, the recording head may have a nozzle surface, and a gap may be made between the flat plate and the nozzle surface in the image recording region, the gap having a height which suppresses any generation of ink mist. In this case, for marginate image recording, particularly when the ink droplets are small, no ink mist is generated from the ink discharged between the recording head and the platen. This prevents the recording image from deteriorating and the recording medium from being stained.

In the image recording apparatus according to the present invention, the platen may be formed as an integrally molded part including the upstream ribs, the regional rib, the bottom plate, the ink channels and the flat plate. In this case, the platen can be molded integrally out of synthetic resin or the like so as to be produced at a low cost.

The image recording apparatus according to the present invention may be an ink jet printer. This recording apparatus is suitable as an ink jet printer because it enables marginless image recording without staining the recording medium with surplus ink.

The image recording apparatus according to the present invention may be a multi-function apparatus with printing, copying, scanning and facsimile functions. For these various functions, this recording apparatus enables marginless image recording without staining the recording medium with surplus ink.

DETAILED DESCRIPTION OF A PREFERRED EMBODIMENT

A preferred embodiment of the present invention will be described below with reference to the drawings.

Figure 1:
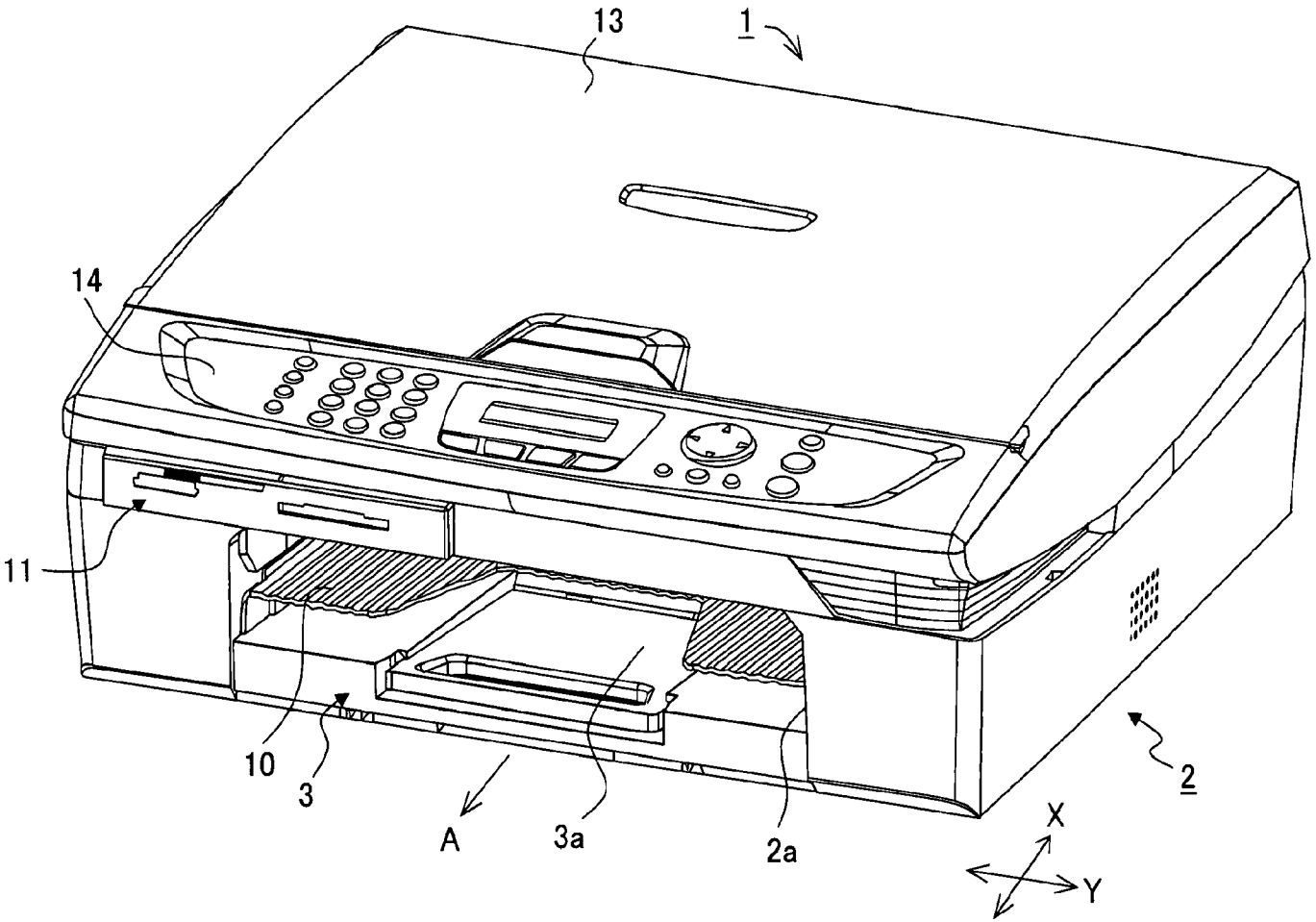
FIG. 1 is a perspective view of an image recording apparatus according to the present invention.

As shown in FIG. 1, an image recording apparatus 1 has a housing 2 made of synthetic resin. The housing 2 has a front opening 2*a*, which is partitioned into an upper section and a lower section. An insertable paper cassette 3, from which recording media (sheets P) are fed, is disposed in the lower section of the opening 2*a*. The upper section of the opening 2*a* functions as a discharge port 10, from which sheets P with images recorded on them are discharged.

In the embodiment, the form of the paper cassette 3 is such that a pile of sheets P can be stored with their short sides extending in a direction (along the Y axis) perpendicular to the conveying direction (along the X axis) in which the sheets P are conveyed. The sheets P may be cut sheets of A4 size, letter size, legal size, postcard size or other sizes. The paper cassette 3 is fitted with an auxiliary support 3*a* at its front end movably along the X axis. The auxiliary support 3*a* supports rear end portions of sheets P of legal size or other long sheets. When sheets P of A4 size or other sheets that can be put in the paper cassette 3 (and do not protrude from the housing 2 through the opening 2*a*) are used, the auxiliary support 3*a* can be retracted into a front portion of the paper cassette 3 so as not to interfere with the paper feeding.

An image reading unit is positioned in an upper portion of the housing 2 and reads an original or operates otherwise for the copying and faxing functions. The image reading unit can pivot on an axis (not shown) to open upward and close downward with respect to one end of the housing 2. An original cover 13 covers the top surface of the image reading unit. The rear end of the original cover 13 is supported on the rear end of the image reading unit so that the cover can pivot up and down.

With the original cover 13 opened upward, an original is put on an original glass plate so that the image on the original can be read by an original reading image scanner (CIS: contact image sensor) which is disposed under the glass plate and reciprocates in a primary scanning direction (along the Y axis).

An operating panel 14 is provided in front of the original cover 13 on the top side of the housing 2 and has operating buttons, a liquid crystal display, etc. An external memory port 11 is provided under the operating panel 14 on the front side of the housing 2. An external memory, to be inserted into the memory port 11, may be Compact Flash (a registered trademark), Smart Media (a registered trademark), Memory Stick (a registered trademark), SD Card (a registered trademark) or xD (a registered trademark).

Figure 4:
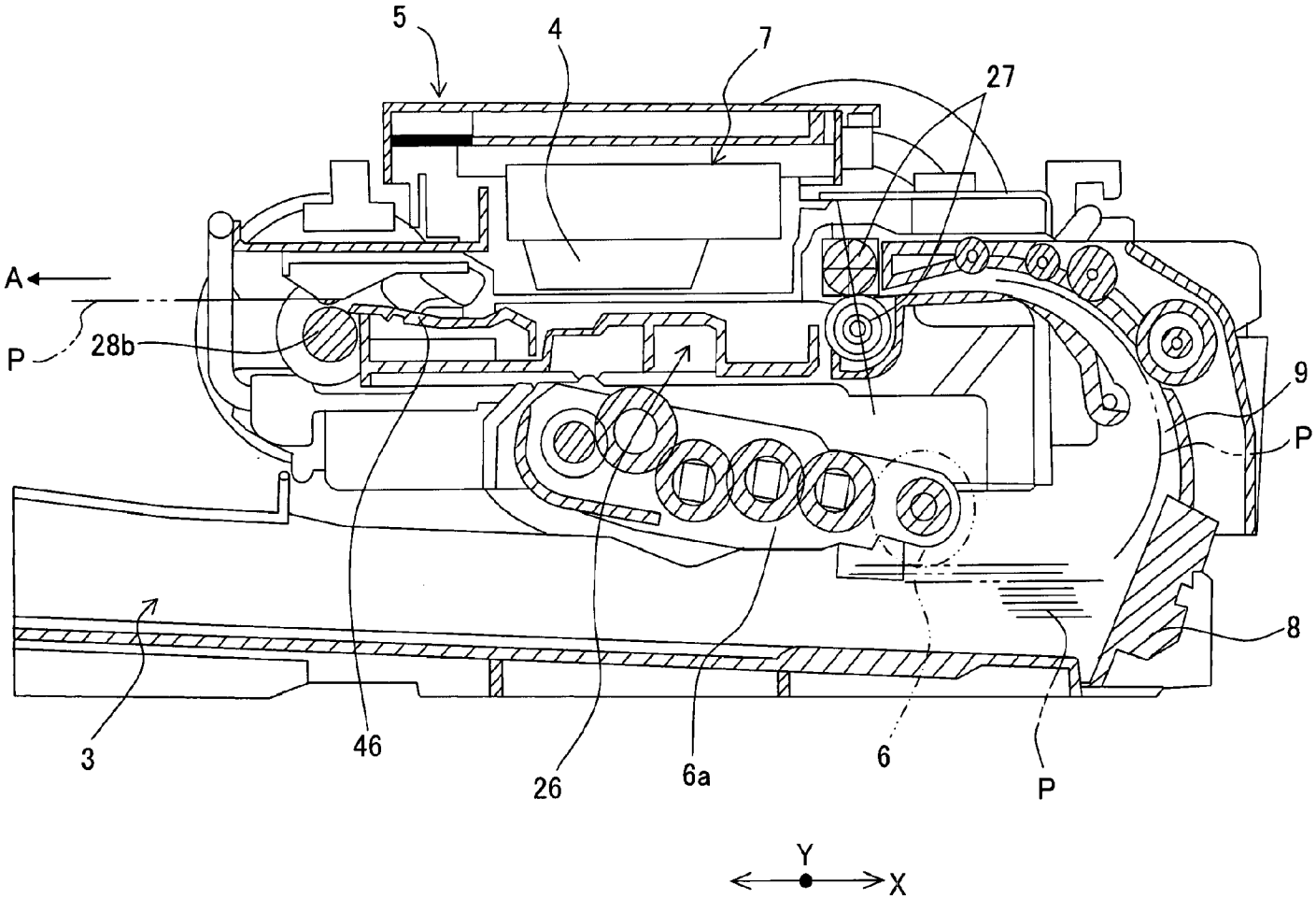
FIG. 4 is a sectional view taken along line IV-IV in FIG. 3.

As shown in FIG. 4, a bank 8 for sheet separation is positioned at the back of the paper cassette 3 (on the right side of FIG. 4). The housing 2 is fitted with an arm 6*a*, an upper end portion of which can turn up and down. The arm 6*a* is fitted with a feed roller 6 at its lower end. The feed roller 6 cooperates with the bank (inclined separation plate) 8 to separate and convey one by one the sheets P piled as recording media in the paper cassette 3. A separated sheet P is conveyed through an upwardly and horizontally curving U-turn path (a feed path) 9 to a record section 7, which is positioned at the back of and at a position higher than (above) the paper cassette 3. As will be stated later on in detail, the record section 7 includes a reciprocatable carriage 5, in which an ink jet recording head 4 for implementing the printing function etc. is mounted. A sheet P with an image recorded thereon in the record section 7 is discharged with its recorded side facing upward through a discharge section 10 in the direction of an arrow A.

Figure 2:
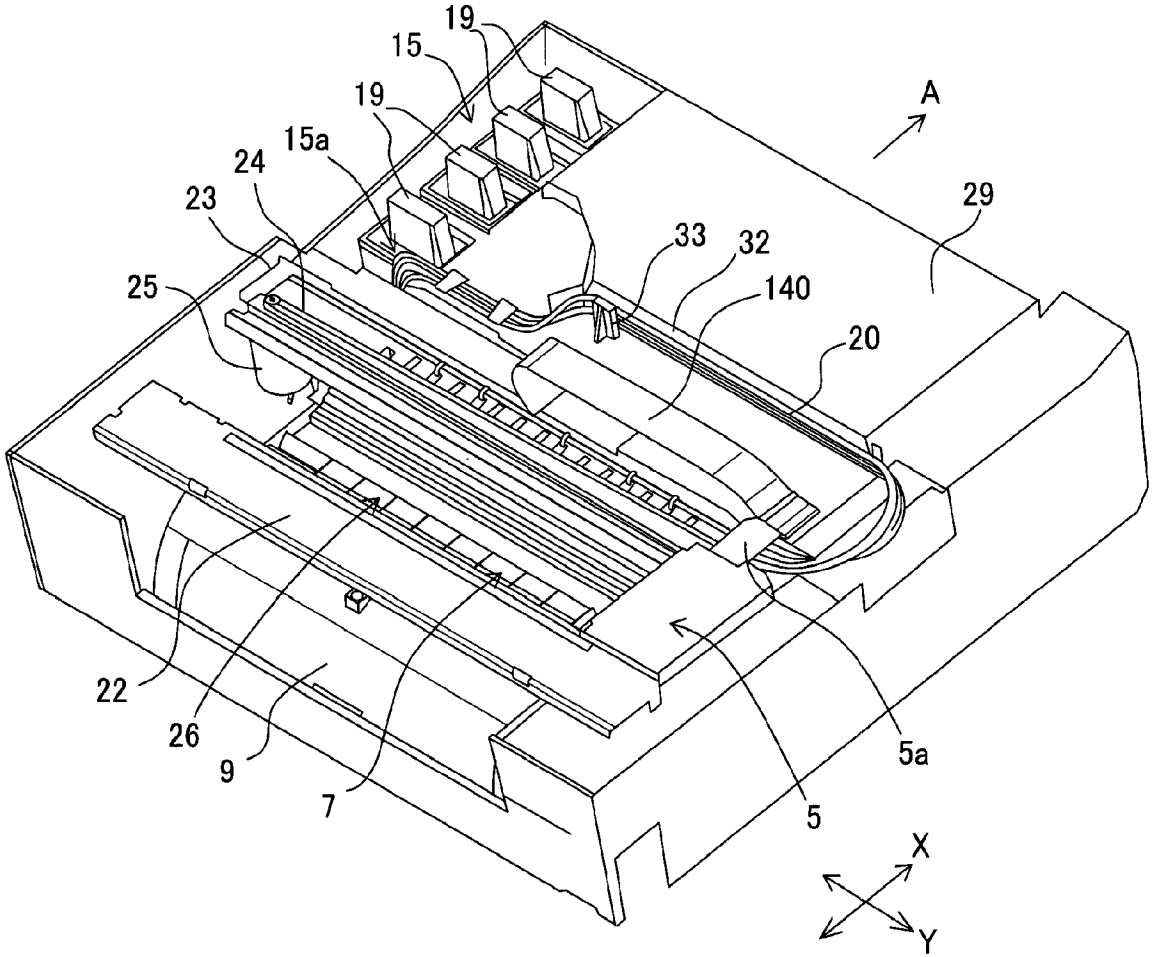
FIG. 2 is a perspective view of the image recording apparatus with its image reading unit removed.
Figure 3:
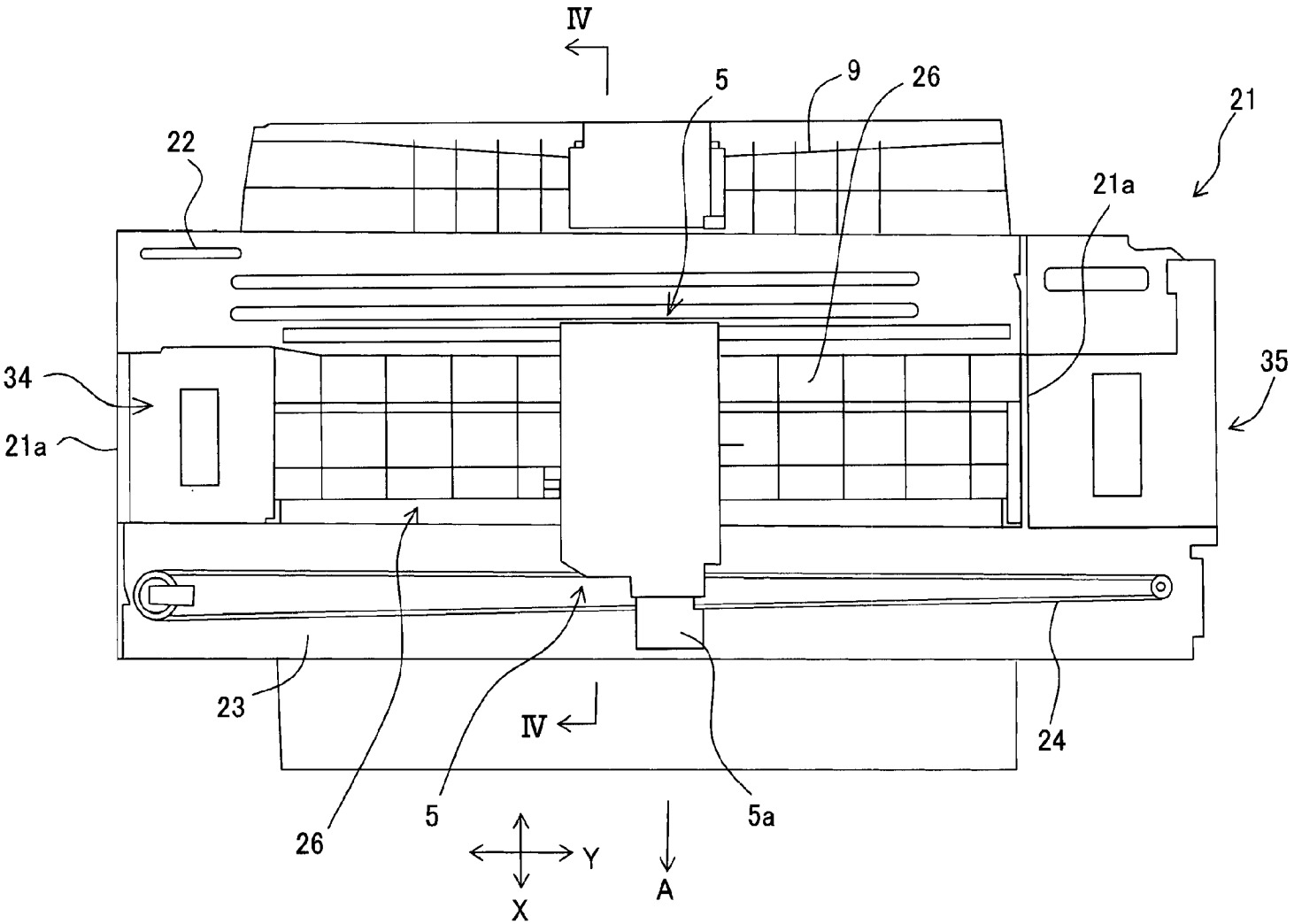
FIG. 3 is a plan view of the record section of the image recording apparatus.

As shown in FIGS. 2, 3 and 4, the record section 7 includes guides 22 and 23 in the form of plates, a carriage 5, a timing belt 24, a CR (carriage) motor 25, a platen 26 in the form of a generally flat plate and an encoder strip (not shown) in the form of a belt. The guides 22 and 23 are supported by a pair of side plates 21*a* of a main frame 21 formed of a metal plate or the like. The guides 22 and 23 extend in the primary scanning direction along the Y axis. The carriage 5 is supported by the guides 22 and 23 slidably over the space between the guides 22 and 23 so as to reciprocate along them. A recording head 4 is mounted in the carriage 5 which can be reciprocated by the timing belt 24. The guide 23 is positioned downstream in the conveying direction (direction of the arrow A). The timing belt 24 extends over and in parallel with the downstream guide 23. The CR motor 25 drives the timing belt 24. The platen 26 supports the sheet P being conveyed under the recording head 4. The encoder strip extends along the Y axis and detects the position of the carriage 5 along the Y axis. The encoder strip has an inspection surface (a surface with slits formed at regular intervals along the Y axis) and is positioned so that this surface is along the vertical direction.

Figure 5:
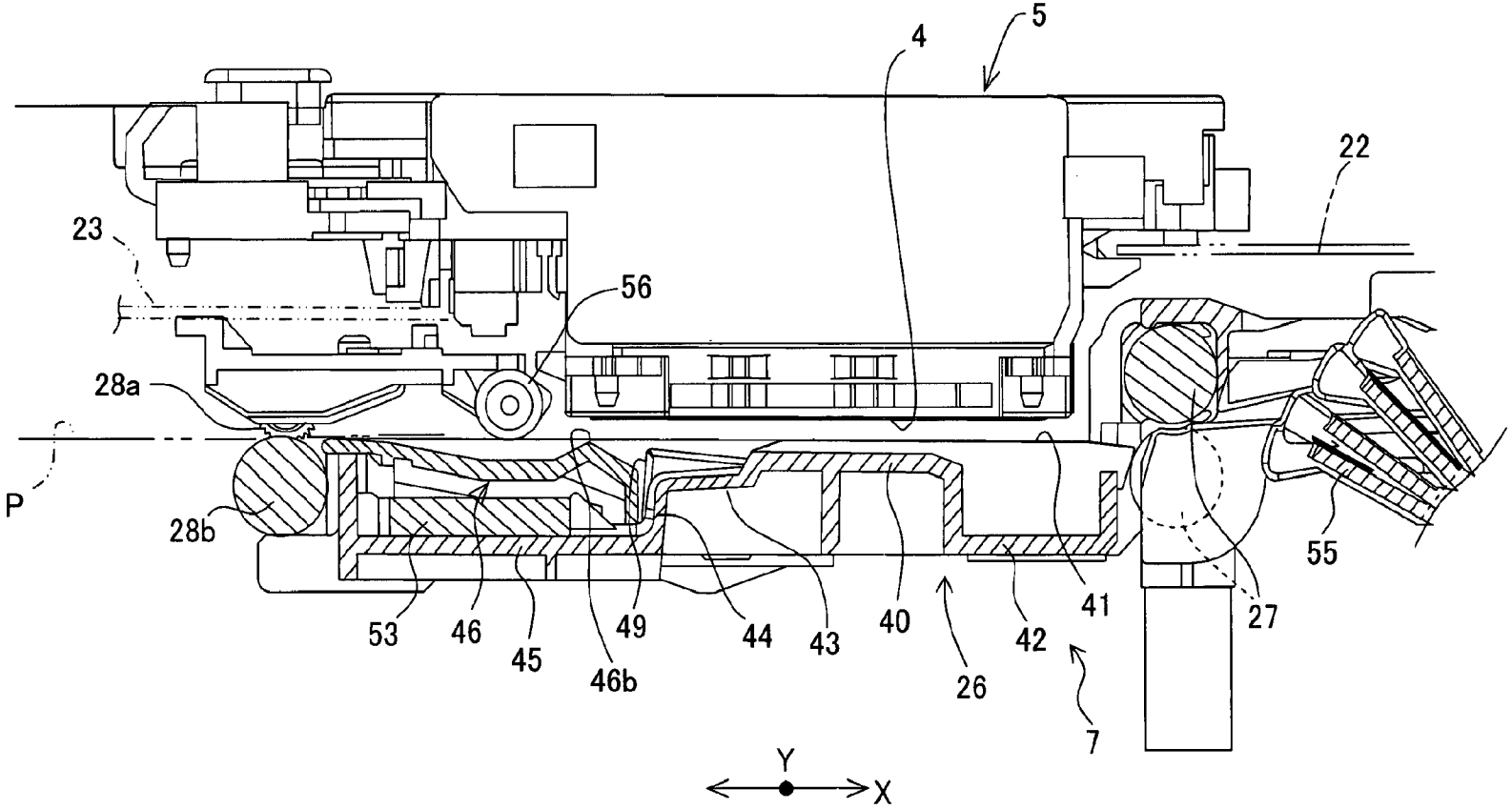
FIG. 5 is a sectional side view of main parts of the record section.

As shown in FIGS. 4 and 5, a pair of resist rollers 27 is positioned upstream of the platen 26 in the conveying direction and feeds a sheet P to an under surface of the recording head 4. A spur roller 28*a* and a discharge roller 28*b* are positioned downstream of the platen 26. The upper and under sides of a sheet P come into contact with the spur roller 28*a* and discharge roller 28*b*, respectively, which convey a sheet P with an image recorded thereon to the discharge section 10.

As shown in FIG. 3, an ink receiving section 34 and a maintenance unit 35 are positioned outside the width (short side edges) of a sheet P being conveyed. The ink receiving section 34 is adjacent to one side of the sheet P (near the left side plate 21*a*), and the maintenance unit 35 is adjacent to the other side (near the right side plate 21*a* in FIG. 3 in the embodiment). The maintenance unit 35 is fitted to the pair of guides 22 and 23. The recording head 4 discharges ink periodically during recording in a flushing position in the ink receiving section 34 to prevent the nozzles of the head 4 from clogging up. The carriage 5 stands by at the maintenance unit 35, which cleans the bottom side of the recording head 4, selectively sucks inks of different colors and performs recovery processing for removing the air bubbles in a buffer tank (not shown) on the recording head 4.

As shown in FIG. 2, an ink storage section 15 is positioned between the adjacent sides of the record section 7 and the discharge section in the housing 2, and is open toward the top of the housing 2 (corresponding to the lower case in the present invention). The storage section 15 can house ink cartridges 19 in the form of substantially rectangular boxes in a row along the X axis. The ink cartridges 19 is detachable from the storage section 15 through its open top. Each of the ink cartridges 19 stores one of inks of the four colors (black (BK), cyan (C), magenta (M) and yellow (Y)) for full color recording. The ink cartridges 19 are small in area in plan view and tall.

Ink is supplied from the ink cartridges 19 to the ink jet recording head 4 through a plurality of ink tubes (four in number in the embodiment) 20. For more than four ink colors (six to eight colors, for example), the storage section 15 can be adapted to house ink cartridges according to the number of cartridges, and the ink tubes 20 may be increased according to the number of cartridges. The front end of each of the ink tubes 20 is connected to a connecting part 5*a* of a connector at the base of the carriage 5.

As shown in FIG. 2, the ink tubes (four in number in the embodiment) 20 are tied at one end 15*a* of the storage section 15 and extend along the Y axis on the top side of a bottom cover 29 from its one side (the left side in FIG. 2) to the other side (the right side in FIG. 2). All ink tubes 20 are arranged in a lateral row along the substantially horizontal bottom cover 29. At least (middle or other) portions of the ink tubes 20 are supported on the upper side of the bottom cover 29.

All ink tubes 20 are twisted so that the middle portions thereof extend along one of the (substantially) vertical surfaces of the laterally extending vertical partition plate 32 on the bottom cover 29. The middle portions of all ink tubes 20 are fixed in a vertical row between this vertical surface of the partition plate 32 and a fixture 33 in the form of a vertical plate made of synthetic resin. The fixture 33 faces the vertical surface of the partition plate 32 and is screwed or otherwise fixed.

The main body of the recording apparatus is provided with a control unit (not shown) which transmits, via a flexible flat cable 140, a command signal for discharging ink droplets selectively from nozzles of the recording head 4 mounted on the carriage 5. The flexible flat cable 140 extends roughly in parallel with the ink tubes 20 in the region where the ink tubes pass while the carriage 5 is reciprocating along the Y axis. The flexible flat cable 140 extends to the connector of the carriage 5, to which an end portion of the cable is connected.

The middle portions of the ink tubes 20 are curved in one of the directions in which the carriage 5 reciprocates, and a middle portion of the flexible flat cable 140 is curved in the opposite direction. In other words, the ink tubes 20 extend in one direction with respect to the connecting part of the carriage 5, and the flexible flat cable 140 extends in the opposite direction with respect to the carriage 5. The middle portion of the flexible flat cable 140 is curved so as to turn over.

The recording head 4 has rows of nozzles for different colors formed on the bottom side (nozzle surface) of the recording head 4. The nozzle rows extend along the X axis and are spaced at suitable intervals along the Y axis. In the embodiment, the nozzle rows are four in number for the four ink colors. The nozzles in each row are spaced at intervals of 75 dpi.

With reference to FIGS. 5-13, the structure of the platen 26 will be described below in detail.

The image recording apparatus 1 according to the present invention has a marginless image recording mode, in which an image can be recorded from the leading end to the trailing end of a sheet P being conveyed in the direction A. In this mode, the image is recorded without margins on the right and left sides of the sheet P. A user can select either the marginless image recording mode or a marginate image recording mode by means of a selection command.

As shown in FIGS. 5 and 9A-9C, the platen 26 of the embodiment is a molded synthetic resin product in the form of a substantially rectangular box in plan view. The platen 26 has an upper deck (a flat plate) 40 in the form of a flat plate and a plurality of upstream ribs 41. The upper deck 40 is positioned upstream in the conveying direction and faces the under side of a sheet P being conveyed. The upstream ribs 41 extend along the X axis on the upper deck 40 and are arranged at suitable intervals along the Y axis. The upper deck 40 extends along the Y axis, and an edge of the upper deck 40 upstream in the conveying direction is conjoined with a recessed plate 42, which is open upward and has a front wall, a rear wall and a closed bottom. A downstream edge of the upper deck 40 in the conveying direction is conjoined to a lower deck (stepped deck) 43, which height is lower than that of the upper deck 40 by a suitable size. The lower deck 43 is equivalent in length along the X axis to a marginless recording region G2, which will be described later on. The lower deck 43 slopes downwardly toward downstream in the conveying direction. The lower deck 43 is integrally formed with a downward wall 44 and a bottom plate 45. The lower edge of the lower deck 43 is conjoined to the top of the downward wall 44. The bottom plate 45 extends from the bottom of the downward wall 44 generally horizontally toward downstream in the conveying direction. The bottom plate 45 further extends upward from its downstream edge. These parts are conjoined to a pair of side frames 47 of the platen 26. One of the side frames 47 (the left side frame in FIG. 7) is integrally formed with the ink receiving section 34 formed outside of the one side frame 47.

Figure 6:
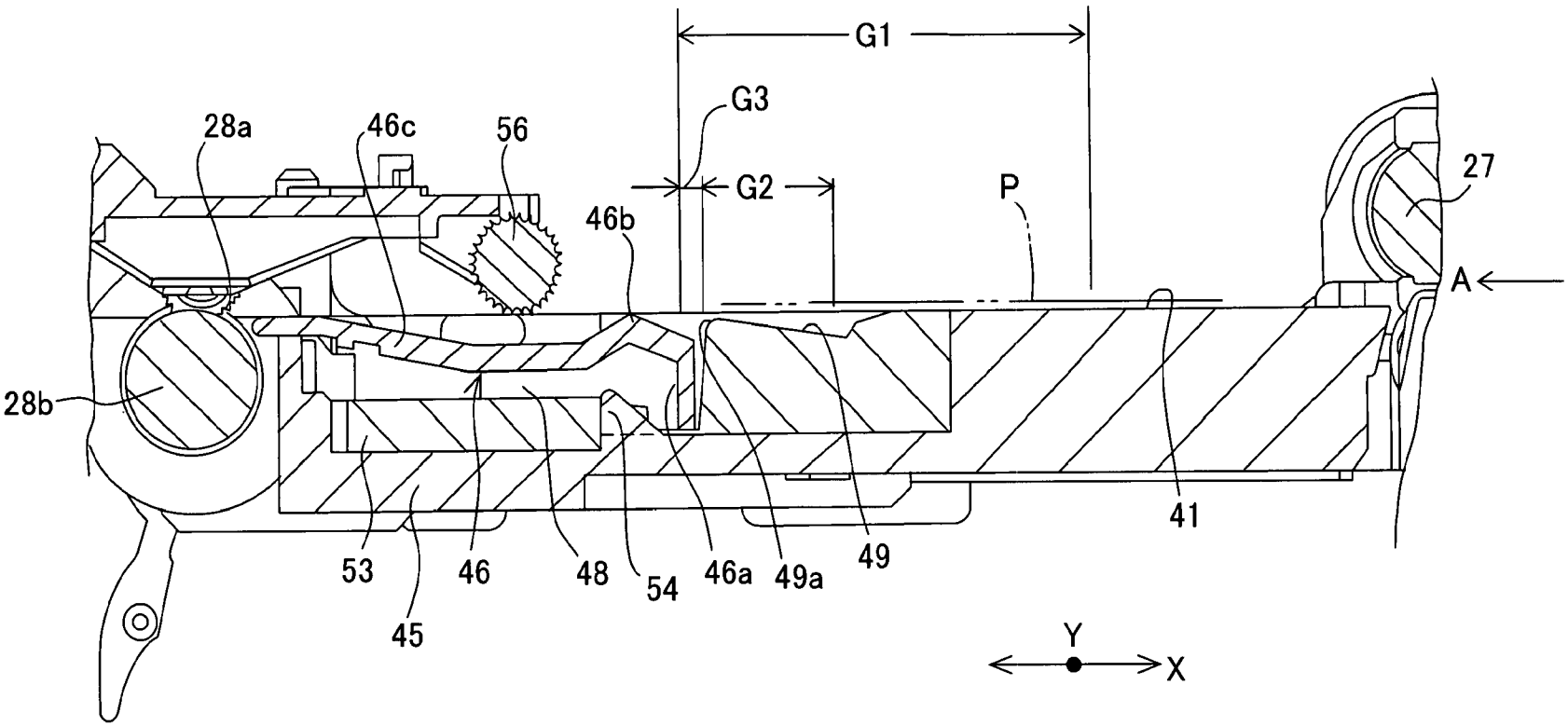
FIG. 6 is an enlarged sectional side view for the description of the operation of the image recording apparatus.
Figure 7:
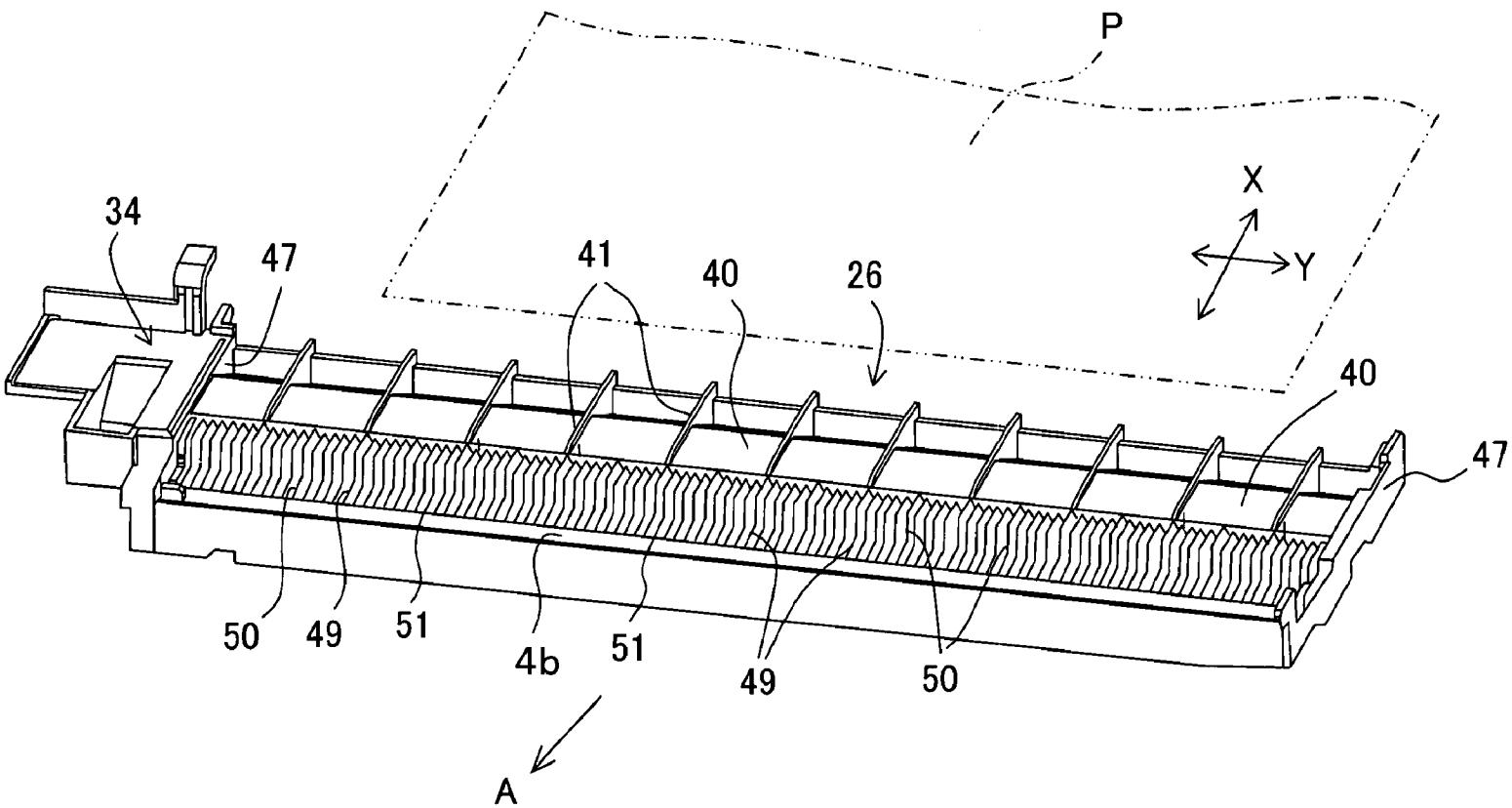
FIG. 7 is a perspective view of the platen of the image recording apparatus.
Figure 8:
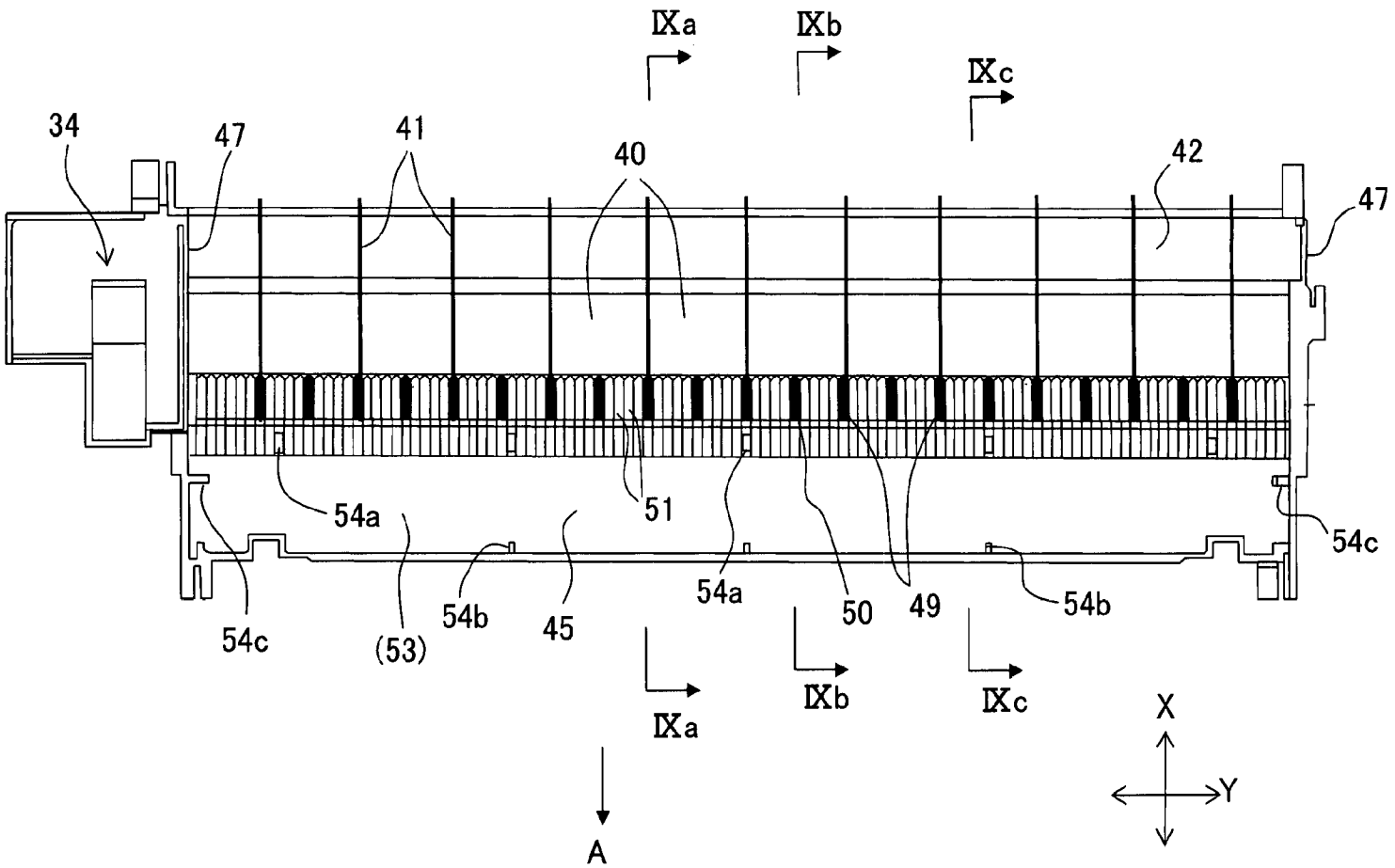
FIG. 8 is a plan view of the platen with its downstream rib removed.

As shown in FIG. 6, the platen 26 is provided with a continuous downstream rib 46 (FIG. 11) extending along the Y axis on its side downstream in the conveying direction. The downstream rib 46 is positioned off a marginate image recording region G1. All of the nozzles of the recording head 4, which are arranged in rows along the X axis, discharge ink in this recording region G1. Because both ends of the downstream rib 46 are attached removably on the pair of side frames 47 of the platen 26, a space 48 of suitable height is formed between the downstream rib 46 and bottom plate 45.

As shown in FIGS. 5 and 6, the downstream rib 46 includes a rising wall 46*a*, a ridge 46*b* and a lower portion 46*c*. The rising wall 46*a* faces the side of the downward wall 44 that is downstream in the conveying direction. The ridge 46*b* is triangular in side view and constitutes of an upward slope and a downward slope. The upward slope extends downstream in the conveying direction from the top of the rising wall 46*a* to the downward slope. The lower portion 46*c* extends downstream in the conveying direction from the ridge 46*b* and covers the space 48. Thus, by forming the downstream rib 46 lengthwise and continuously along the Y axis, it is easy to make the downstream rib 46 in the form of a flat plate so as to be kept out of contact with an ink absorber 53 (described later on in detail) disposed under the rib 46. Even if the ink absorber 53 is thick, the long and continuous rib 46 can be kept out of contact with the ink absorber 53.

As shown in FIG. 5, upstream end portions of the upstream ribs 41 extend to the recessed plate 42, and downstream end portions of the upstream ribs 41 terminate between the decks 40 and 43 (or at the downstream end of the upper deck 40). As shown in FIG. 6, the marginless recording region G2 is set between the downstream ends of the upstream ribs 41 and the upstream end of the downstream rib 46. First regional ribs 49, second regional ribs 50 and third regional ribs 51 extend in the conveying direction (along the X axis) in the marginless recording region G2. The regional ribs 49-51 are of different types and can support front and rear end portions of a sheet P.

Figure 9A:
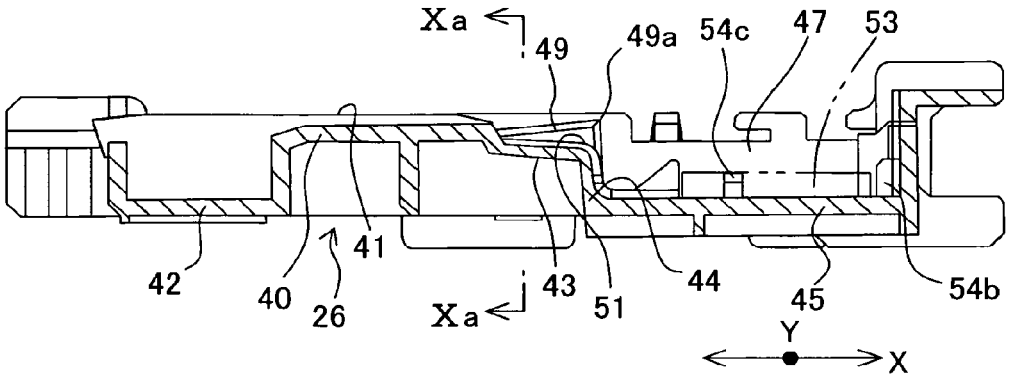
FIGS. 9A-9C are sectional views taken along lines IXa-IXa, IXb-IXb and IXc-IXc, respectively, in FIG. 8.
Figure 9B:
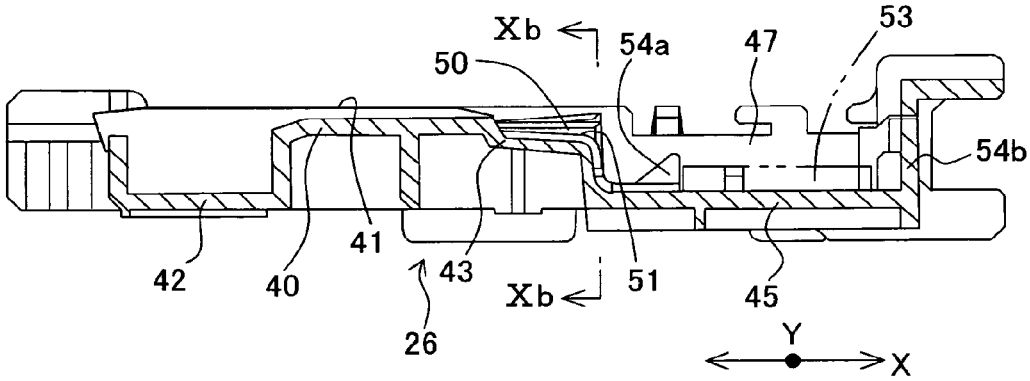
Figure 9C:
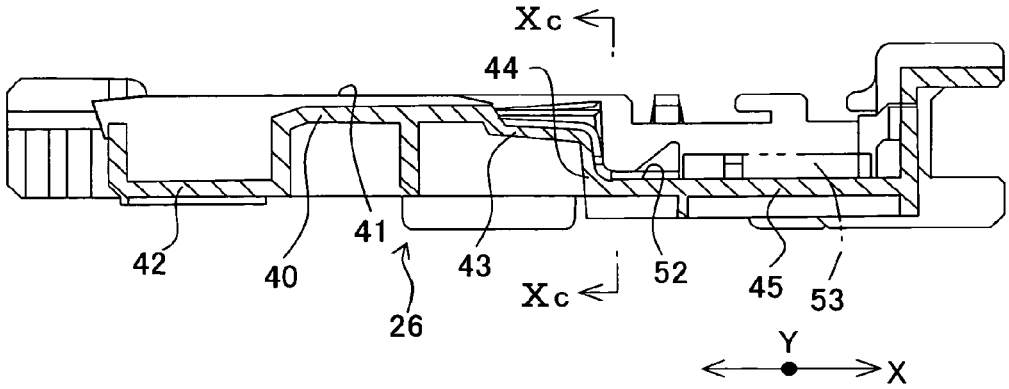
Figure 10A:
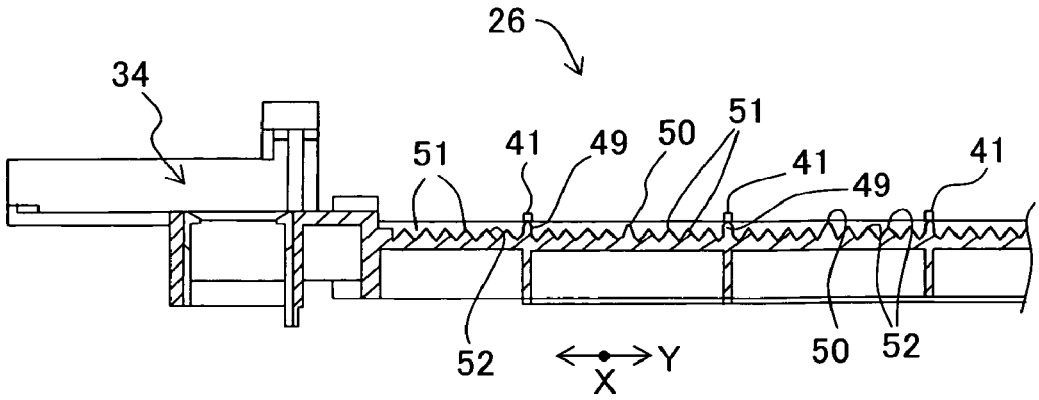
FIGS. 10A-10C are sectional views taken along lines Xa-Xa, Xb-Xb and Xc-Xc in FIGS. 9A-9C, respectively.
Figure 12A:
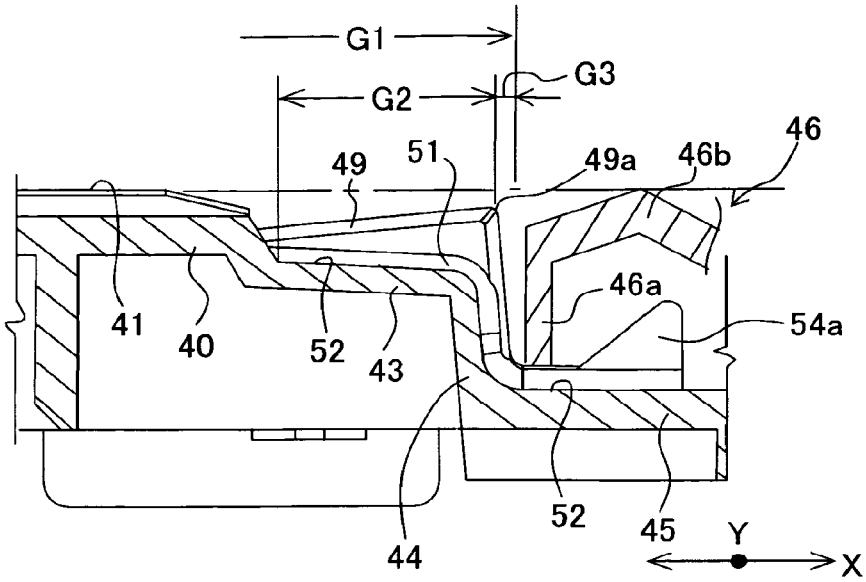
FIGS. 12A-12C are further enlarged sectional views of the platen shown in FIGS. 9A-9C, respectively.

As shown in FIG. 9A, the first regional ribs 49 are formed on the top side of the lower deck 43 to protrude therefrom, and to incline upwardly toward downstream in the conveying direction. With reference to FIG. 10A, each first regional rib 49 is aligned with an axis line in which one of the upstream ribs 41 extends in the conveying direction. With reference to FIG. 12A, the upstream ends of the first regional ribs 49 are positioned between the decks 40 and 43, and the downstream ends of these ribs are positioned at the bottom of the downward wall 44. The apexes of the first regional rib 49 are slightly lower (by 0.7 mm in the embodiment) than the plane extending between the tops of the upstream ribs 41 and the top of the ridge 46*b* of the downstream rib 46. A sheet P passes on this plane between the upstream ribs 41 and downstream rib 46.

Figure 10B:
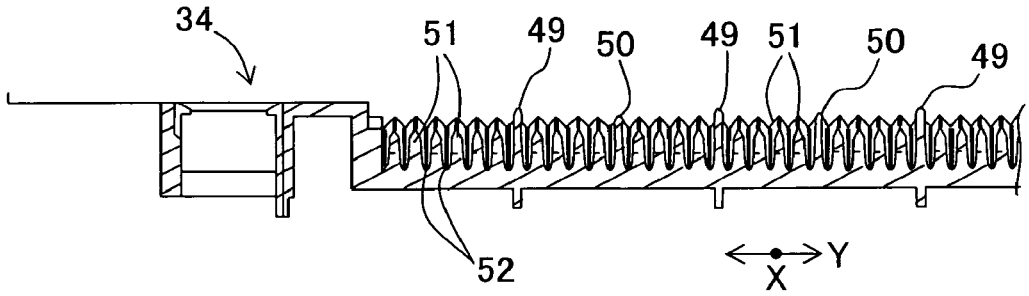
Figure 10C:
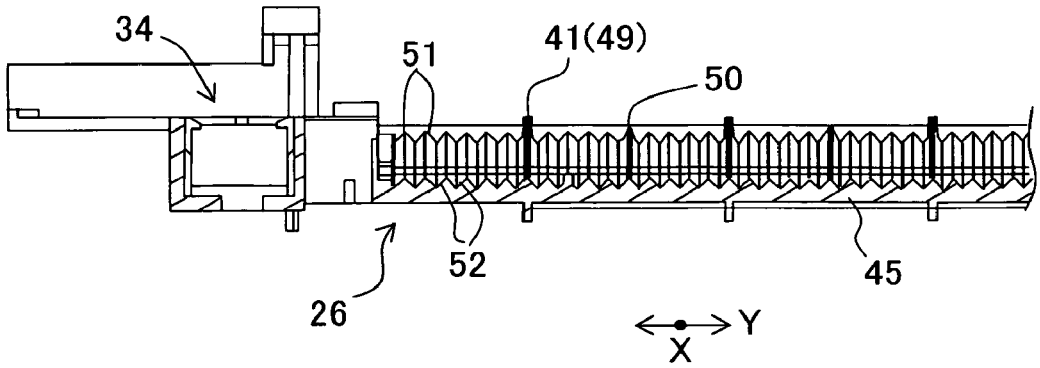
Figure 11:
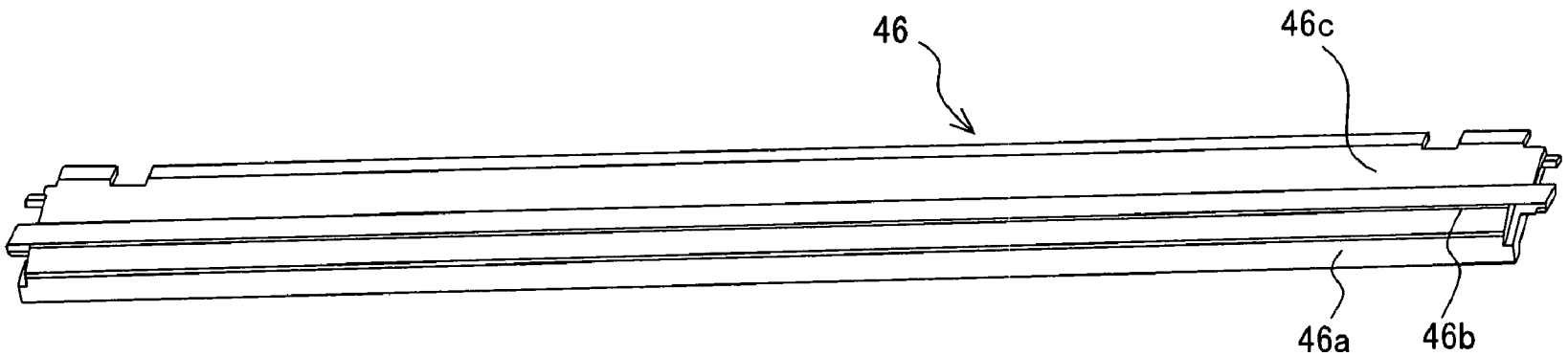
FIG. 11 is a perspective view of the downstream rib.
Figure 12B:
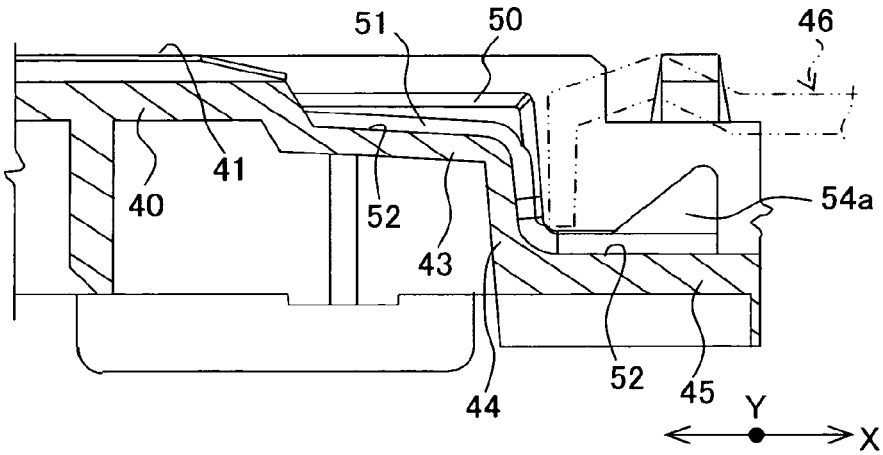

As shown in FIGS. 10A-10C, each of the second regional ribs 50 is interposed midway between two first regional ribs 49 adjoining along the Y axis. The top ends of the second regional ribs 50 are formed to be horizontal and positioned above the top surface of a stepped-down portion of the lower deck 43. The top ends of the second regional ribs 50 are lower than the first regional ribs 49 and higher than the third regional ribs 51. With reference to FIG. 12B, the upstream ends of the second regional ribs 50 are positioned between the decks 40 and 43, and the downstream ends of these ribs are positioned at the bottom of the downward wall 44.

Figure 12C:
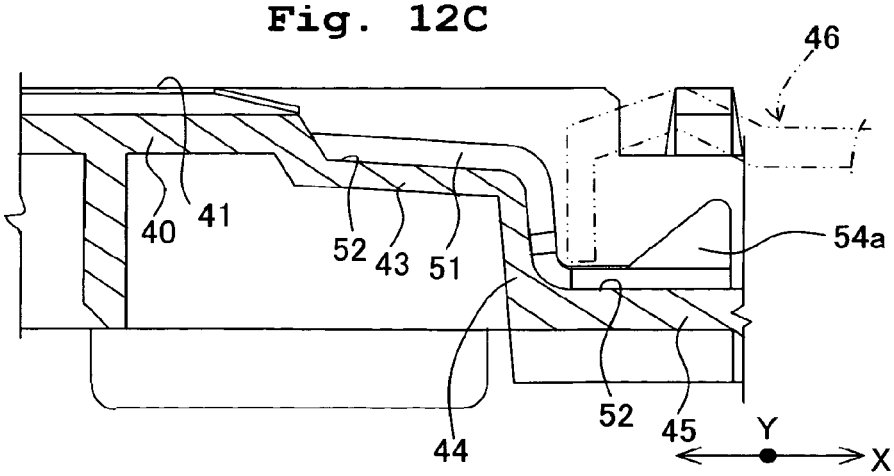
Figure 13:
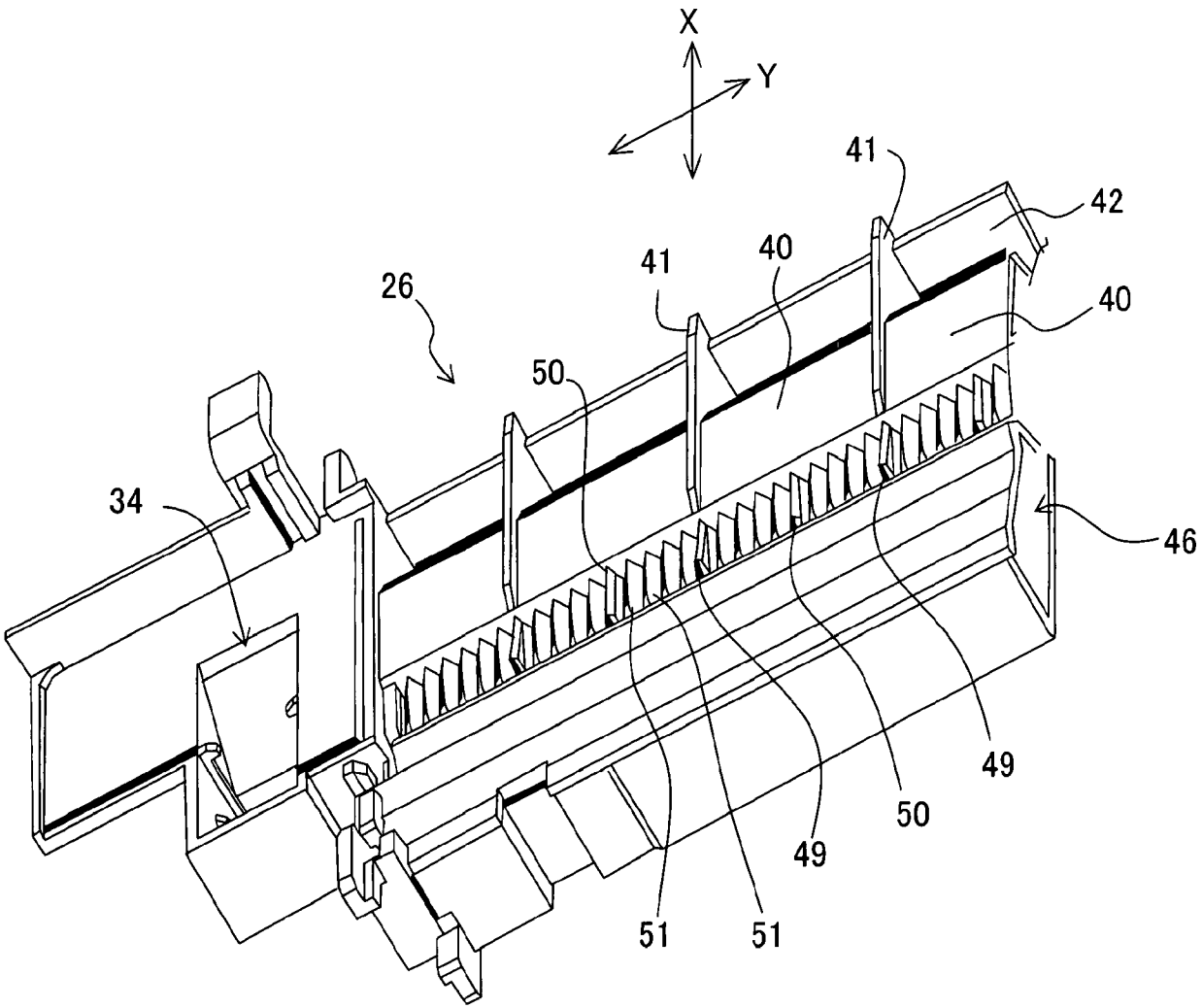
FIG. 13 is a partially cut-away enlarged perspective view of the platen.

The third regional ribs 51 are interposed at regular intervals between the first and second regional ribs 49 and 50. As shown in FIG. 12C, the upstream ends of the third regional ribs 51 are positioned between the decks 40 and 43. The third regional ribs 51 extend beyond the bottom of the downward wall 44, and the downstream ends of the third regional ribs 51 are positioned midway between the upstream and downstream edges of the bottom plate 45. The top ends of the third regional ribs 51 are formed to be positioned above the top surface of a stepped-down portion of the lower deck 43 and to slope downwardly toward downstream in the conveying direction. The top ends of the third regional ribs 51 are lower than those of the first and second regional ribs 49 and 50.

As shown in FIGS. 10A-10C and 12A-12C, grooves 52 are formed between the regional ribs 49-51 and extend downstream in the conveying direction. The grooves 52 is V-shaped in section and are open upward. As shown in FIG. 12C, the upstream ends of the grooves 52 are positioned between the decks 40 and 43. The grooves 52 extend beyond the bottom of the downward wall 44, and the downstream ends of the grooves 52 are positioned nearly at the downstream ends of the third regional ribs 51 (midway between the upstream and downstream edges of the bottom plate 45). The grooves 52 communicate with the place where the ink absorber 53 is placed. Accordingly, the grooves on the bottom plate 45 function as ink channels. The ink absorber 53 for absorbing surplus ink substantially cover the whole upper surface of the bottom plate 45. The ink absorber 53 is made of foamed polyurethane or other porous material. As shown in FIGS. 8 and 9A-9C, the bottom plate 45 has positioning protrusions 54*a*-54*c* formed on its top side at suitable intervals along the four sides of the ink absorber 53, which takes the form of a flat plate. The height of the ink absorber 53 is set so that the absorber is kept out of contact with the bottom of the downstream rib 46.

With reference to FIGS. 6 and 12A, a more detailed description will be given below of the positional relationship between the recording regions G1 and G2 and the regional ribs 49-51. The upstream end of the marginate image recording region G1 is positioned midway between the upstream and downstream ends of the upstream ribs 41. The downstream end of this region G1 is positioned in a gap between the rising wall 46*a* of the downstream rib 46 and the downward wall 44. The upstream end of the marginless recording region G2 is positioned in the conjoined portion of the downstream ends of the upstream ribs 41 and the upstream end of the lower deck 43. The downstream end of this region G2 is positioned at the apexes (angled portions) 49*a* of the first regional ribs 49. Accordingly, there is a small marginal region G3 between the downstream ends of the recording regions G1 and G2. The existence of the marginal region G3 prevents ink from being ejected directly onto the downstream rib 46.

In the embodiment, 75 nozzles (not shown) are arranged over a distance of 1 inch (25.4 mm) along the X axis in the recording head 4. The marginate image recording region G1 covers an area occupied by the 75 nozzles. In this case, the marginal region G3 extends the distance of 1.36 mm from the first nozzle to the sixth nozzle in the conveying direction, and the marginless recording region G2 extends the distance of 7.79 mm from the 7th nozzle to the 28th nozzle in this direction. The marginal region G3 is a region which is formed by corresponding the end of the marginless image recording region G2 to the position of the 7th nozzle which coincides with the position of the apexes (angled portions) 49*a* of the first regional ribs 49 and by not using the first nozzle to the 6th nozzle of the downstream end. In the marginless image recording mode, no ink adheres onto the downstream rib 46 which is disposed further downstream position than the apexes (angled portions) 49*a* of the first regional ribs 49, because the end portion of the marginless recording region is set further upstream in the conveying direction, by the distance corresponding to the width of the marginal region G3, from the end portion of the marginate image recording region G1.

In the foregoing configuration, if a command for image recording is received, a drive motor (not shown) is activated to rotate the feed roller 6, which then feeds a top sheet disposed atop in sheets P piled in the paper cassette 3 to the rightward direction in FIG. 4. The inclined separation plate 8 separates the fed the top sheet P from the other sheets in the paper cassette 3. While the separated sheet P is passing through the U-turn path 9 to the pair of resist rollers 27, the leading end of this sheet P pushes a lever 55 (FIG. 5) downwardly, which then causes a sensor (not shown) to detect the leading end of the sheet P. The sensor then outputs a detection signal, in accordance with which a command for ink discharge is given. This command causes ink to be discharged from nozzles of the recording head 4 when a predetermined time has passed.

In the marginate image recording mode, it is possible to record an image by discharging ink from the 75 nozzles in each nozzle row in the marginate image recording region G1 onto the sheet P being conveyed intermittently in the direction A. In this mode, no ink is discharged onto margins of a predetermined size, which may be 3-5 mm, at both ends and both sides of the sheet P. Accordingly, for example, in this mode, ink starts to be discharged to record an image after the leading end of a sheet P moves downstream in the conveying direction from the downstream end (the most downstream nozzle in the conveying direction) of the marginate recording region G1 by the distance equivalent to the size of the margin of the sheet P, with the apexes 49*a* of the first ribs 49 supporting a front end portion of the sheet P. The ink discharge stops when the trailing end of the sheet P reaches a position that is upstream from the downstream end (the most downstream nozzle in the conveying direction) of the marginate recording region G1 by the distance equivalent to the size of the margin of the sheet P, with the apexes 49*a* supporting a rear end portion of the sheet P.

In this case, because ink is kept discharged onto the sheet P during recording, no ink adheres onto the apexes (angled portions) 49*a* of the first regional ribs 49. This prevents the under side of the sheet P from being stained with ink. Front or rear hanging end portions of the sheet P are supported on the horizontal top ends of the second regional ribs 50 disposed between the first regional ribs 49 adjacent to each other along the Y axis. However, for the same reason as for the first regional ribs 49, no ink adheres onto the top ends of the second regional ribs 50, so that the under side of the sheet P is not stained with ink.

The sheet P with an image recorded with the ink on its upper side is conveyed downstream to the nip between the spur roller 28*a* and discharge roller 28*b*, with a downstream portion thereof supported by the ridge 46*b* of the downstream rib 46. Subsequently, the sheet P is discharged to the discharge section 10. While the sheet P is thus conveyed and discharged, a spur roller 56, which is positioned above the downstream rib 46, keeps the sheet P from warping upward from (floating from) the platen 26. This maintains a gap between the upper surface of the sheet P and the nozzle surface of the recording head 4. The gap is about 1.76 mm in the embodiment. If the gap were too large, the ink droplets discharged from the nozzles would disperse in the air, so that the recorded image would be low in quality. If the gap were too small, the upper surface of the sheet P might come into contact with the nozzle surface of the recording head 4, so that the image recording would be defective or unsatisfactory. The gap between the top surface of the upper deck 40 and the nozzle surface of the recording head 4 is about 2.41 mm in the embodiment. If this gap were too large, the ink droplets discharged from the nozzles of the recording head 4 may not land on the sheet P. In this case, particularly if the ink droplets are small, they are likely to disperse in the form of mist into the air. Therefore, as stated above, the gap between the flat plate and the nozzle surface of the recording head 4 is suppressed to be low enough that no ink mist is generated.

When the leading end of the sheet P, supported by the first regional ribs 49 and moving downstream in the conveying direction, is warped upward, a paper jam is likely to occur before the sheet P reaches the nip between the discharge roller 28*b* and spur roller 28*a*, which are downstream from the first regional ribs 49. The existence of the spur roller 56 prevents particularly a front end portion of the sheet P from warping upward.

In the marginless image recording mode, ink is discharged from 23 nozzles in the marginless recording region G2 to perform a predetermined marginless image recording. In this mode, also, the under side of the sheet P is not stained with ink for the following reason.

In the marginless image recording mode, when the leading end of the sheet P being conveyed downstream and supported on the upstream ribs 41 enters the marginless recording region G2, namely, over the lower deck 43, ink starts to be discharged from upstream nozzles among the 7th to 28th nozzles used for marginless recording and counted from the downstream end of the recording head 4 in the conveying direction. For performing a completely marginless recording, ink is discharged, as appropriate, additionally from nozzles disposed at positions further downstream in the conveying direction from the leading end of the sheet P. The surplus ink, dropping outside the leading end of the sheet P, adheres onto the top ends of the regional ribs 49-51 and in the grooves 52. The ink on the top ends of the regional ribs 49-51 and in the grooves 52 flows through these grooves, so that no surplus ink remains on the top ends of these ribs. The under side of a front end portion of the sheet P is kept out of contact with the top ends of the regional ribs 49-51, which are lower than the top ends of the upstream ribs 41.

When the leading end of a sheet P being conveyed intermittently is supported on the apexes 49*a* of the first regional ribs 49, the ink discharge for the leading end has ended, and image recording is performed on the portion of the sheet P that is upstream from the leading end. Accordingly, no ink adheres onto the regional ribs 49-51. With the rib ridge 46*a* supporting a rear end portion of the sheet P, and with the rib apexes 49*a* supporting the trailing end of the sheet P, marginless recording is performed for the trailing end. For performing a completely marginless recording, likewise, ink is discharged, as appropriate, additionally from nozzles disposed at portion further upstream in the conveying direction from the trailing end of the sheet P. The surplus ink, dropping outside the trailing end of the sheet P, adheres onto the top ends of the regional ribs 49-51 and in the grooves 52. The top ends of the second and third regional ribs 50 and 51 are lower than the apexes 49*a* of the first regional ribs 49. Accordingly, the under side of a rear end portion of the sheet P, which is kept out of contact with the top ends of the second and third regional ribs 50 and 51, is prevented from being stained with the ink. In general, sheets of paper of high picture (image) quality (for photographs or graphic printing) that are hardly warped are used for marginless image recording. The heights of the upstream ribs 41 and regional ribs 49-51 are set such that the front end portion of such a sheet of high picture quality supported on the upstream ribs 41 are kept out of contact with the front ends of the regional ribs 49-51, and that the rear end portion of the sheet supported on the apexes 49*a* of the first regional ribs 49 is kept out of contact with the top ends of the second and third regional ribs 50 and 51. Even when the front end portion of the sheet of high picture quality hangs down and comes into contact with the first regional ribs 49, or even when the rear end portion of the sheet of high picture quality hangs down and comes into contact with the second regional ribs 50, the under side of the sheet is not stained with ink because no surplus ink remains on the top ends of these regional ribs 49 and 50.

The ink on the regional ribs 49-51 and in the grooves 52 flows through these grooves down on the downward wall 44 and bottom plate 45 and is absorbed by the ink absorber 53. The regional ribs of the present invention may have at least the first regional ribs 49. It is sufficient that the grooves 52 are grooves which guides the ink to the ink absorber 53 placed outside the marginless image recording region G2.

When the ink absorber 53 is placed in an image recording region under the marginate image recording region G1 or marginless image recording region G2 in the platen 26, it may be troublesome to position the absorber 53 so that a sheet P can pass while having no contact with the top side of the absorber 53, and to control dimension errors in forming the absorber 53. In the present invention, a place for housing the ink absorber 53 is formed in the platen 26 outside the recording regions G1 and G2. Consequently, the mounting operation of the ink absorber 53 becomes simple, and the control of the dimension errors becomes simple since a large dimension errors, if occurred, causes no problem. Because it is easy to make the ink absorber 53 large in size, the absorber 53 can be replaced at long intervals, so that the maintenance of the image recording apparatus is easy.

An image recording apparatus 1 according to the embodiment is a multi-function device (MFD) with printing, copying, scanning and facsimile functions. However, the present invention may be applied to an ink jet printer only with a printing function. Sheets P such as sheets of paper or plastic films are used as recording media for the embodiment. However, the recording media are not limited to sheets of paper or plastic films, but various recording media may be used.

Alternatively, an accommodating section for the ink absorber 53 may be provided in a position separate from platen 26, and separate ink channels may be provided to connect the platen 26 and the ink absorber 53.

Alternatively, the downstream rib 46 may be divided along the Y axis into a plurality of parts arranged in continuous form. The CR motor 25 of the embodiment is a DC motor, but may be a stepping motor or another motor.

What is claimed is:

1. A platen which supports an under side of a recording medium being conveyed in a conveying direction in an image recording apparatus, and which is disposed below a recording head capable of marginless image recording on the recording medium, the platen comprising:

a plurality of upstream ribs which support the recording medium and which are disposed upstream in the conveying direction;

a downstream rib which supports the recording medium and which is disposed downstream in the conveying direction outside an image recording region where the recording head records an image on the recording medium;

a regional rib which extends between the upstream ribs and the downstream rib in the conveying direction and which supports and physically contacts a front end portion of the recording medium in a marginless recording region located inside the image recording region;

an ink absorber which absorbs ink dropped onto the regional rib, the ink absorber being positioned under the downstream rib; and an ink guide which guides the ink dropped onto the regional rib toward the ink absorber;

wherein the ink absorber has an upstream end positioned downstream in the conveying direction with respect to the image recording region, and the ink guide extends in the conveying direction from the regional rib to the upstream end of the ink absorber.

2. The platen according to claim 1, wherein the image recording apparatus has a carriage reciprocatable in a predetermined direction, and the recording medium is conveyed in a direction perpendicular to the predetermined direction.

3. The platen according to claim 1, wherein the regional rib comprises:

first ribs formed to incline upwardly toward downstream in the conveying direction;

second ribs which are horizontal; and third ribs formed to incline downwardly toward downstream in the conveying direction.

4. The platen according to claim 1, wherein the downstream rib is formed separately from the regional rib and keeps the recording medium from contacting the ink absorber.

5. An image recording apparatus which records an image on a recording medium being conveyed in a conveying direction, the image recording apparatus comprising:

a carriage which is reciprocatable in a direction perpendicular to the conveying direction;

a recording head which performs marginless image recording on the recording medium by discharging ink droplets, the recording head being mounted on the carriage; and a platen which supports an under side of the recording medium, the platen being disposed below the recording head;

wherein the platen comprises:

a plurality of upstream ribs which support the recording medium, the upstream ribs being disposed upstream in the conveying direction;

a downstream rib which supports the recording medium, the downstream rib being disposed downstream in the conveying direction outside an image recording region where the recording head records an image on the recording medium; and a regional rib which extends between the upstream ribs and the downstream rib in the conveying direction and which supports and physically contacts a front end portion of the recording medium in a marginless recording region located inside the image recording region;

an ink absorber which absorbs ink dropped onto the regional rib, the ink absorber being positioned under the downstream rib; and an ink guide which guides the ink dropped onto the regional rib toward the ink absorber;

wherein the ink absorber has an upstream end positioned downstream in the conveying direction with respect to the image recording region, and the ink guide extends in the conveying direction from the regional rib to the upstream end of the ink absorber.

6. The image recording apparatus according to claim 5, further comprising a conveying unit which conveys the recording medium in the conveying direction.

7. The image recording apparatus according to claim 5, wherein the downstream rib is formed continuously in a direction perpendicular to the conveying direction of the recording medium.

8. The image recording apparatus according to claim 5, wherein a top end of the regional rib is lower than a surface on which the recording medium passes over the upstream ribs and the downstream rib at the same time.

9. The image recording apparatus according to claim 5, wherein the regional rib comprises:

first ribs formed to incline upwardly toward downstream in the conveying direction;

second ribs which are horizontal; and third ribs formed to incline downwardly toward downstream in the conveying direction.

10. The image recording apparatus according to claim 9, wherein the upstream ribs extend in the conveying direction;

each of the first ribs is aligned with an axial direction in which one of the upstream ribs extends in the conveying direction;

each of the second rib is interposed midway between adjoining first ribs of the first ribs, the second ribs preventing the recording medium from hanging down between the first ribs; and the third ribs are interposed between the first and second ribs in the direction perpendicular to the conveying direction.

11. The image recording apparatus according to claim 9, wherein top ends of the first ribs are lower than top ends of the upstream ribs; top ends of the second ribs are lower than the top ends of the first ribs; and top ends of the third ribs are lower than the top ends of the second ribs.

12. The image recording apparatus according to claim 5, wherein the regional rib comprises a plurality of ribs; and the ink guide comprises grooves which are formed between adjoining ribs of the plurality of ribs and extend in the conveying direction beyond the image recording region; and the ink absorber is disposed in a position communicating with the grooves.

13. The image recording apparatus according to claim 12, wherein the downstream rib is detachable from the platen; the platen further comprises a bottom plate positioned under the downstream rib; and the ink absorber is mounted on the bottom plate.

14. The image recording apparatus according to claim 12, wherein the platen further comprises a base plate on which the ink absorber is disposed, and the grooves extend from the regional rib into the base plate.

15. The image recording apparatus according to claim 14, wherein the platen is formed as an integrally molded part including the upstream ribs, the regional rib, the base plate, and the grooves.

16. The image recording apparatus according to claim 5, wherein the platen further comprises a flat plate on which the upstream ribs are integrally formed, the recording head has a nozzle surface, and a gap is made between the flat plate and the nozzle surface in the image recording region, the gap having a height which suppresses any generation of ink mist.

17. The image recording apparatus according to claim 5, which is an ink jet printer.

18. The image recording apparatus according to claim 5, which is a multi-function apparatus with printing, copying, scanning and facsimile functions.

19. The image recording apparatus according to claim 5, wherein the downstream rib is formed separately from the regional rib and keeps the recording medium from contacting the ink absorber.

* * * * *